United States Patent [19]

Nowatzki et al.

[11] 4,062,523

[45] Dec. 13, 1977

[54] BAND FASTENING DEVICE FOR FASTENING A FENCE TO A POST

[76] Inventors: Michael Nowatzki, 710 Bruce Road, Lockport, Ill. 60411; Norman J. Schmitt, R.R. No. 1 Francis Road, Mokena, Ill. 60448

[21] Appl. No.: 728,960

[22] Filed: Oct. 4, 1976

[51] Int. Cl.[2] ..... E04H 17/12

[52] U.S. Cl. ..... 256/47; 24/73 SA; 24/73 B

[58] Field of Search ..... 256/47, 37, 32; 24/73 SA, 73 B, 73 R, 20 W, 20 S, 20 LS, 84 B; 248/74 B, 61

[56] References Cited

U.S. PATENT DOCUMENTS

| | | | |
|---|---|---|---|
| 1,134,132 | 4/1915 | Hotchkin | 248/74 B |
| 1,804,775 | 5/1931 | Hull et al. | 248/61 |
| 2,338,754 | 1/1944 | Bonas | 24/73 SA |
| 2,947,055 | 8/1960 | McHenry | 256/47 X |
| 2,992,801 | 7/1961 | Lander | 248/74 B |
| 2,997,278 | 8/1961 | Pinson | 256/47 |
| 3,022,044 | 2/1962 | Gugino | 256/47 |
| 3,544,071 | 12/1970 | Case | 256/47 |

FOREIGN PATENT DOCUMENTS

| | | | |
|---|---|---|---|
| 963,699 | 7/1964 | United Kingdom | 24/73 B |

*Primary Examiner*—Andrew V. Kundrat

[57] ABSTRACT

A band for attaching a fence to a post, one end portion of the band being formed into a circular loop, the end of said portion being secured to said band at an intermediate position along said band, the other end portion of said band forming a shank the end of which is provided with a hook for engaging the fence. One means for securing said end of said one portion to said band includes a slot in said band and a tongue at the end of said one portion and an alternate means involves an end tab on said one portion which lies against the band and a fastener extending through said tab and through said band.

3 Claims, 5 Drawing Figures

BAND FASTENING DEVICE FOR FASTENING A FENCE TO A POST

BACKGROUND

There are many occasions where a fence such as a wire mesh fence under tension is to be attached to a post. The posts are commonly in the form of cylindrical pipes or casings set in the ground in a vertical fashion. It has been the practice to provide vertical stretcher bars which are enmeshed with the fence, and to use a band fastener for attaching the vertical stretcher bars to the post.

The band fasteners which have heretofore been used commonly extend about the post and about the stretcher bar with their ends being secured by bolts extending therethrough. The bolts and nuts are an inconvenience and take time and effort to assemble. Further, it is possible for vandals easily to loosen the nuts with pliers or even with their fingers, and with the bolts removed the fasteners fail and the fence is let loose.

It is an object of the present invention to provide an improved band for fastening fence to a post. We have sought a band fastening device which is extremely simple of construction and economical in its manufacture. We have also sought such a band fastening device which is economical in its manufacture which can be easily installed and which firmly binds the fence to the post. Further, it is desired that the band not be subject to easy release by tampering while the fence is under tension. Other objects and advantages of the present invention will be apparent on reference to the following more detailed description.

DESCRIPTION

Two embodiments of our improved band fastener are illustrated in the accompanying drawings in which -

Figure 1:
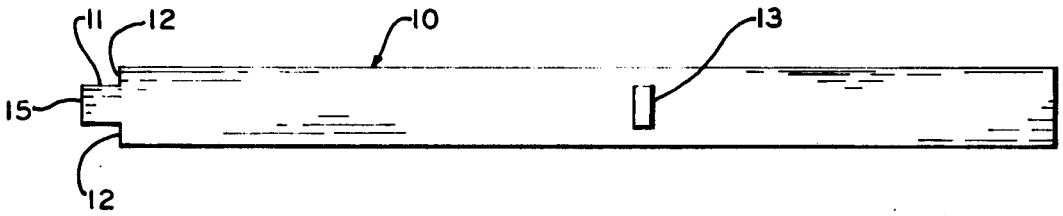
FIG. 1 is a view of the elongated blank which may be used in the manufacture of one modification of the improved band.
Figure 2:
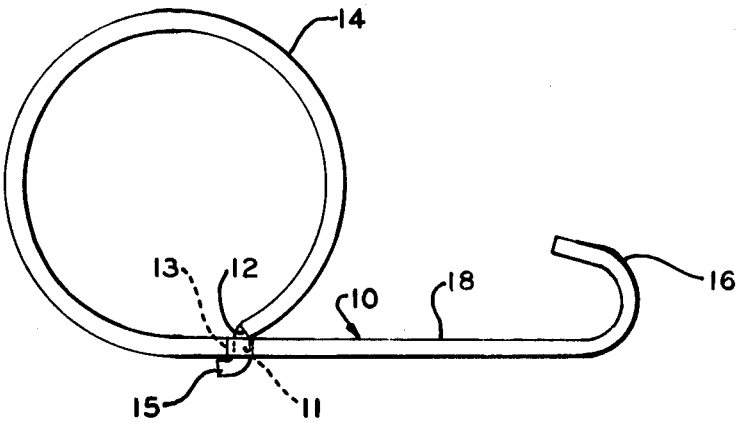
FIG. 2 is a plan view of the blank of FIG. 1 after this piece has been bent to form the improved band.
Figure 3:
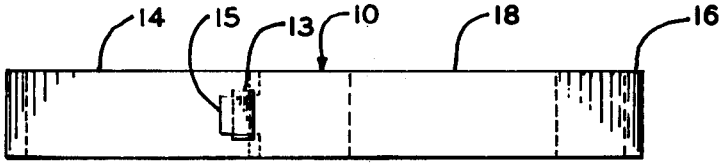
FIG. 3 is a side view of the band shown in FIG. 2.

As illustrated in FIGS. 1 to 4, the improved attachment band may be made from an elongated blank 10. Suitably, this piece may be of steel or other metal and if it is to be used on a post two inches in outside diameter, for example, may have the typical dimensions of 3/4 inch width by 10 inches in length. The band may, of course, be longer or shorter in length to accommodate posts of different diameters.

The blank 10 may first be stamped to form at one end thereof a tongue 11, and at the base of the tongue the shoulders 12 on each side of the tongue. Also in the stamping operation the slot 13 may be formed. This slot extends transversely of the longitudinal axis of the band and its ends are inward of the edges of the band. The size of the slot 13 is such that it will receive the tongue 11 therethrough.

The stamped band 10 is then bent at its one end portion to form the circular loop 14. This loop has a diameter such that it will fit over the post of the size to which the fence is to be attached. At the completion of the formation of the loop the tongue 11 is inserted into the slot 13 preferably to the extent that the shoulders 12 of the band rest firmly against the inside of the band. After this, the tip 15 of the tongue is bent over, suitably by passing a die along the outside of the band. The tip may be bent preferably toward the loop 14 or may be bent toward the other end of the band. In either case, this end portion of the band will be securely locked in loop form.

Either before or after the formation of loop 14 the other end of the band may be bent to form the hook 16. The dimensions of the hook 16 need only be such as to embrace and engage the stretch bar of the fence.

Figure 4:
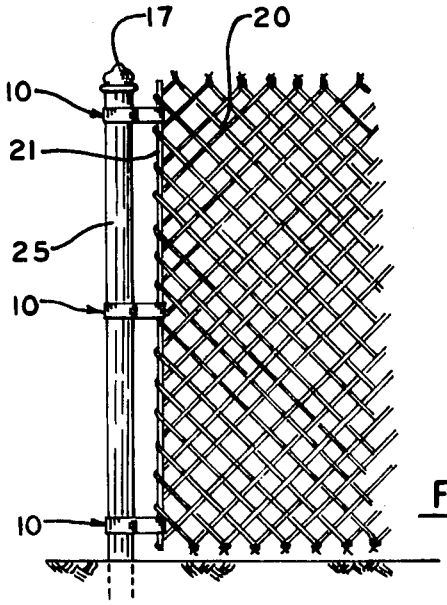
FIG. 4 is a side view of the improved band illustrated in FIGS. 1 to 3 when installed to bind the fence to the post.

Use of the improved band attachment device is illustrated particulary in FIG. 4 of the drawing. As shown in FIG. 4, the fence 20 is provided with a vertical stretch bar 21 and the post 25 is vertical and cylindrical in shape. In the course of installation of the band for attaching the fence to the post, the operator first selects the band having the loop of a size which will fit over the post and with the caps 17 removed slips a number of the improved bands over the top of the post. As illustrated in FIG. 4, three such bands are used, one for the top of the fence, one for the bottom, and one for the middle. Then the operator stretches the fence using a mechanical stretcher of a well-known type so as to bring the stretch bar up close to the post. Then the band devices are positioned to bring their hooks 16 behind the stretch bar at their respective positions; and the stretcher is then released so that the stretch bars are engaged by the hooks of the band devices. In this condition the fence is under tension and bears hard against the hooks. The fence cannot be released by hand, and in the event it is desired to release the fence from the post the normal way to do this would be again to use the stretcher to bring the fence under greater tension and so loosen the engagement of hooks 16 with the stretch bar.

The end portion of the band which includes the hook 16 has a shank 18 extending from slot 13 to the hook 16 which shank is substantially straight. This shank is preferably two or more inches in length. This facilitates the placement of the hook 16 behind the stretcher bar when the fence is stretched.

Figure 5:
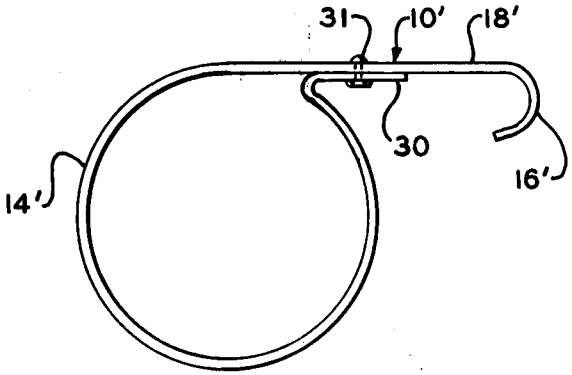
FIG. 5 is a plan view of a modified form of the invention in which the attachment of the end of the loop portion of the band is attached to an intermediate portion of the band by means of an end tab which is riveted to the band.

In the modification illustrated in FIG. 5 the improved band may be formed from the elongated blank 10'. This blank may be of the same materials and of the same sizes as mentioned in connection with the elongated blank 10 of the embodiment first described.

Blank 10' may have its one end portion bent to form the loop 14'.

The other end portion of 10' extends forwardly to form the shank 18', and the looped end portion has near its extreme end a tab 30 which is bent back and lies parallel to and in flat contact with the base of the shank 18'. As the loop 14' and tab 30 are being formed a hole may be punched in the tab 30 and through the base of the shank 18'. A rivet 31 may be passed through the holes in the tab and the shank and the rivet expanded to secure the tab to the band. The end of the other portion is bent to form the hook 16'.

The rivet attachment as shown in FIG. 5 and the tongue and slot attachment as shown in FIG. 1 is each at an intermediate position along the band. This position is usually at the base of the shank member close to the curve of the loop.

Other means of attachment include welding or the use of a bolt and nut which are permanently fixed when the band is fabricated.

While we have illustrated and described in detail only certain embodiments of our improved band for attaching a fence to a post, it will be apparent to those skilled in this art that other embodiments may be constructed and many changes may be made, all within the spirit of this invention and the scope of the appended claims.

We claim:

1. A band for attaching a fence to a post comprising an elongated band having a flat shank portion which has a slot therein, one end portion of said band being turned to one side of said shank portion to form a loop and having a tongue at the end thereof which extends through said slot, said tongue having a tip extending on the other side of said shank, said tip being bent rearwardly of said shank and toward said loop to lock said tongue in place, the other end portion of said band having its end turned toward said one side of said shank and toward said loop to provide a hook for engaging said fence.

2. A fence and post structure comprising a cylindrical post, a fence, a vertical stretch bar attached to said fence, and a band having a flat shank portion having a slot therein, one end portion of said band being turned to one side of said shank portion to form a loop which embraces said post, said one end portion having a tongue at the end thereof which extends through said slot, said tongue having a tip extending on the other side of said shank, said tip being bent toward said loop to lock said tongue in place, the other end portion of said band having its end turned to said one side and extending through said fence toward said loop and engaging said stretch bar.

3. A process for attaching to a cylindrical post a fence having a vertical stretch bar therein comprising forming a slot in a flat metal strip, turning the one end portion of said strip to one side to form a loop, passing the extreme end of said portion through said slot so that its tip extends on the other side of said strip, pressing said tip toward said loop to lock said loop, turning the other end of said strip to said one side to form a hook, passing said loop while in locked condition over the top of said post, and moving said hook into engagement with said stretch bar.

* * * * *